US006019107A

United States Patent [19]

Overmyer et al.

[11] Patent Number: 6,019,107

[45] Date of Patent: Feb. 1, 2000

[54] DETACHABLE HAIRPIECE

[76] Inventors: Tatiana L Overmyer; Donald P Vesely, both of 10772-D W. Florida, Lakewood, Colo. 80232

[21] Appl. No.: 09/195,954

[22] Filed: Nov. 19, 1998

[51] Int. Cl.[7] ..... A41G 3/00; A45D 8/12

[52] U.S. Cl. ..... 132/53; 132/275; 132/201

[58] Field of Search ..... 132/53, 54, 55, 132/201, 275, 277, 279, 120, 146, 148; 15/106, 185, 203

[56] References Cited

U.S. PATENT DOCUMENTS

| | | | |
|---|---|---|---|
| Re. 15,849 | 5/1924 | Scheanblum et al. | 132/53 |
| 193,304 | 7/1877 | Wells | 132/53 |
| 1,686,636 | 10/1928 | Oppenheim | 132/53 |
| 1,714,358 | 5/1929 | Finkelstein | 132/54 |
| 2,165,716 | 7/1939 | Molleson | 132/53 |
| 3,500,836 | 3/1970 | Jordan | 132/53 |
| 4,830,029 | 5/1989 | Bird | 132/54 |
| 5,323,793 | 6/1994 | Lorenzi | 132/275 |
| 5,501,239 | 3/1996 | Walker | 132/275 |
| 5,546,966 | 8/1996 | Lin | 132/279 |

*Primary Examiner*—Gene Mancene
*Assistant Examiner*—Pedro Philogene

[57] ABSTRACT

A detachable hairpiece for attaching to existing hair to create the appearance of longer hair. The detachable hairpiece includes a clip for clipping to a wearer's hair. The clip has an outer portion and a brush portion that is pivotally coupled to the outer portion. The brush portion has a brush panel that extends between opposed side members of the brush portion. The brush panel has a plurality of rows of prongs. Each of the rows extends between the first and second end members of the brush portion. Root portions of a plurality of strands of natural or synthetic hair are coupled to the outer portion.

20 Claims, 2 Drawing Sheets

DETACHABLE HAIRPIECE

BACKGROUND OF THE INVENTION

1. Field of the Invention

The present invention relates to artificial hairpieces and more particularly pertains to a new detachable hairpiece for attaching to existing hair to create the appearance of longer hair.

2. Description of the Prior Art

The use of artificial hairpieces is known in the prior art. More specifically, artificial hairpieces heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,254,783; U.S. Pat. No. Des. 356,398; U.S. Pat. No. 1,714,358; U.S. Pat. No. 3,485,249; U.S. Pat. No. 5,337,763; and U.S. Pat. No. 4,788,991.

While these devices fulfill their respective, particular objectives and requirements, the aforementioned patents do not disclose a new detachable hairpiece. The inventive device includes a clip for clipping to a wearer's hair. The clip has an outer portion and a brush portion that is pivotally coupled to the outer portion. The brush portion has a brush panel that extends between opposed side members of the brush portion. The brush panel has a plurality of rows of prongs. Each of the rows extends between the first and second end members of the brush portion. Root portions of a plurality of strands of natural or synthetic hair are coupled to the outer portion.

In these respects, the detachable hairpiece according to the present invention substantially departs from the conventional concepts and designs of the prior art, and in so doing provides an apparatus primarily developed for the purpose of attaching to existing hair to create the appearance of longer hair.

SUMMARY OF THE INVENTION

In view of the foregoing disadvantages inherent in the known types of artificial hairpieces now present in the prior art, the present invention provides a new detachable hairpiece construction wherein the same can be utilized for attaching to existing hair to create the appearance of longer hair.

The general purpose of the present invention, which will be described subsequently in greater detail, is to provide a new detachable hairpiece apparatus and method which has many of the advantages of the artificial hairpieces mentioned heretofore and many novel features that result in a new detachable hairpiece which is not anticipated, rendered obvious, suggested, or even implied by any of the prior art artificial hairpieces, either alone or in any combination thereof.

To attain this, the present invention generally comprises a clip for clipping to a wearer's hair. The clip has an outer portion and a brush portion that is pivotally coupled to the outer portion. The brush portion has a brush panel that extends between opposed side members of the brush portion. The brush panel has a plurality of rows of prongs. Each of the rows extends between the first and second end members of the brush portion. Root portions of a plurality of strands of natural or synthetic hair are coupled to the outer portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new detachable hairpiece apparatus and method which has many of the advantages of the artificial hairpieces mentioned heretofore and many novel features that result in a new detachable hairpiece which is not anticipated, rendered obvious, suggested, or even implied by any of the prior art artificial hairpieces, either alone or in any combination thereof.

It is another object of the present invention to provide a new detachable hairpiece which may be easily and efficiently manufactured and marketed.

It is a further object of the present invention to provide a new detachable hairpiece which is of a durable and reliable construction.

An even further object of the present invention is to provide a new detachable hairpiece which is susceptible of a low cost of manufacture with regard to both materials and labor, and which accordingly is then susceptible of low prices of sale to the consuming public, thereby making such detachable hairpiece economically available to the buying public.

Still yet another object of the present invention is to provide a new detachable hairpiece which provides in the apparatuses and methods of the prior art some of the advantages thereof, while simultaneously overcoming some of the disadvantages normally associated therewith.

Still another object of the present invention is to provide a new detachable hairpiece for attaching to existing hair to create the appearance of longer hair.

Yet another object of the present invention is to provide a new detachable hairpiece which includes a clip for clipping to a wearer's hair. The clip has an outer portion and a brush portion that is pivotally coupled to the outer portion. The brush portion has a brush panel that extends between opposed side members of the brush portion. The brush panel has a plurality of rows of prongs. Each of the rows extends between the first and second end members of the brush portion. Root portions of a plurality of strands of natural or synthetic hair are coupled to the outer portion.

Still yet another object of the present invention is to provide a new detachable hairpiece that is more comfortable to wear than conventional hairpieces.

Even still another object of the present invention is to provide a new detachable hairpiece that may be used saves time when adding artificial braids and extensions by clipping on to existing hair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
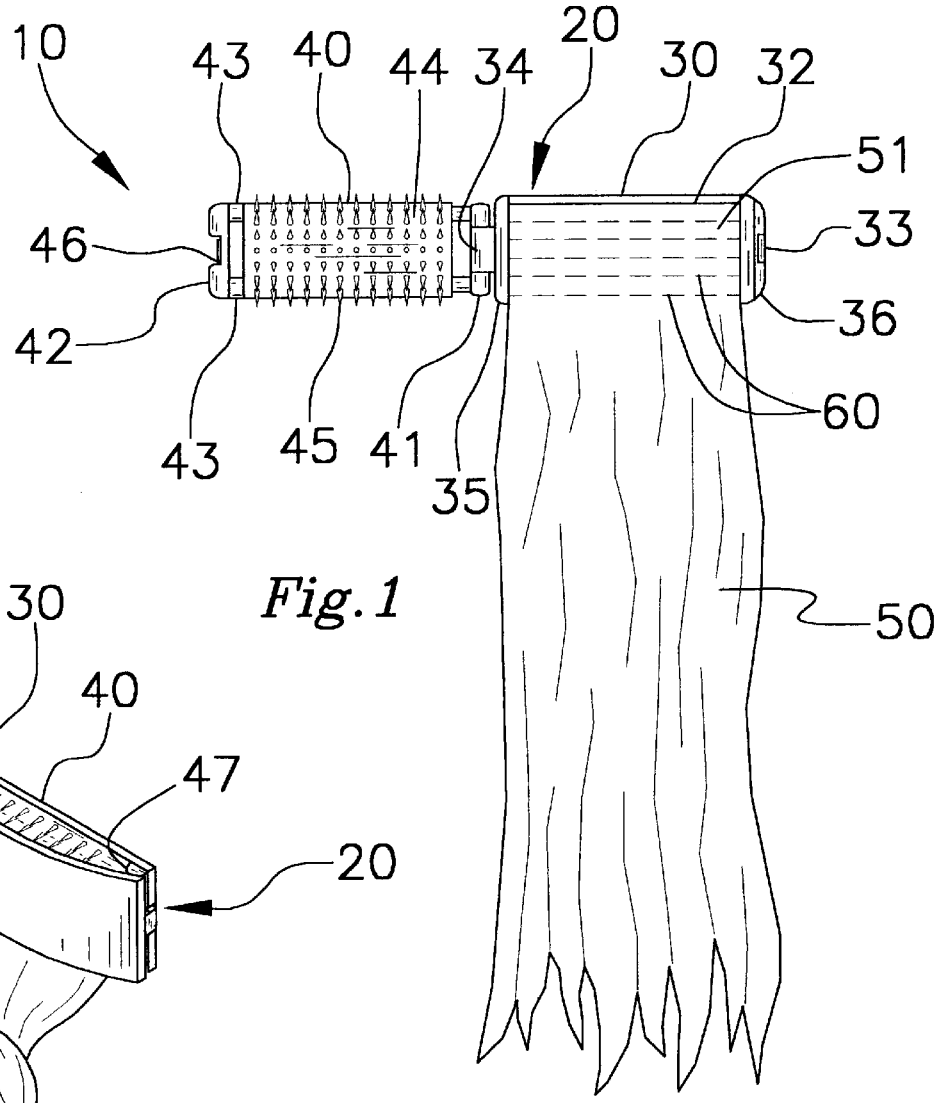
FIG. 1 is a schematic side view of a new detachable hairpiece according to the present invention.
Figure 2:
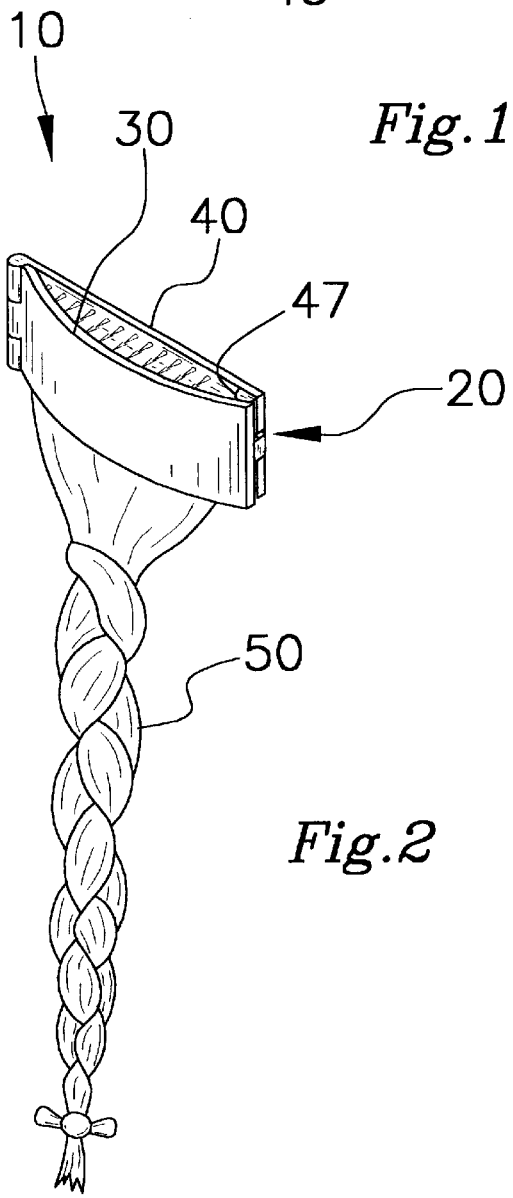
FIG. 2 is a schematic perspective view of the present invention.
Figure 3:
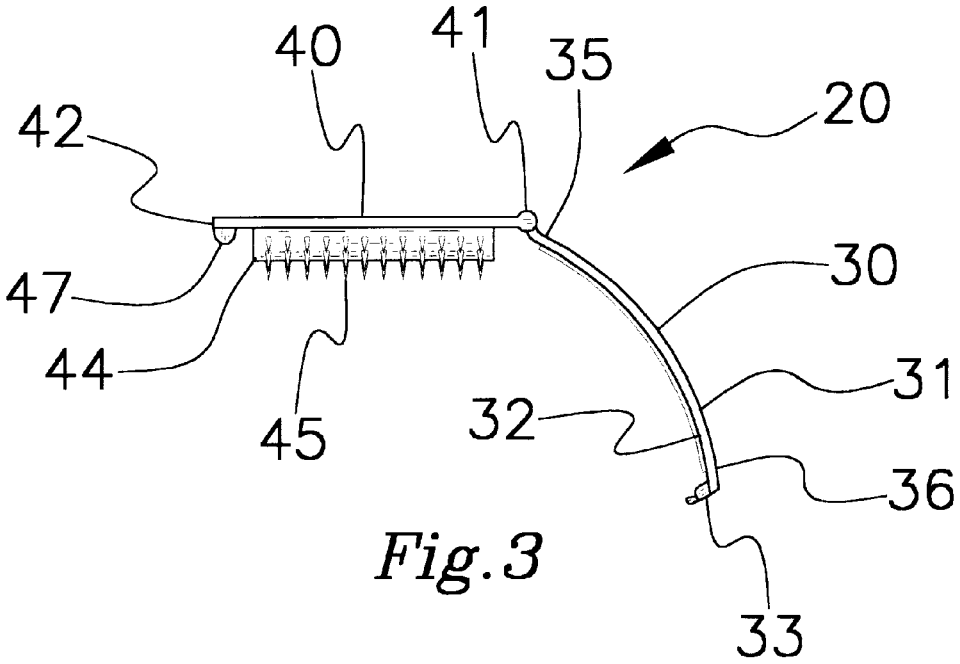
FIG. 3 is a schematic side view of a clip of the present invention.
Figure 4:
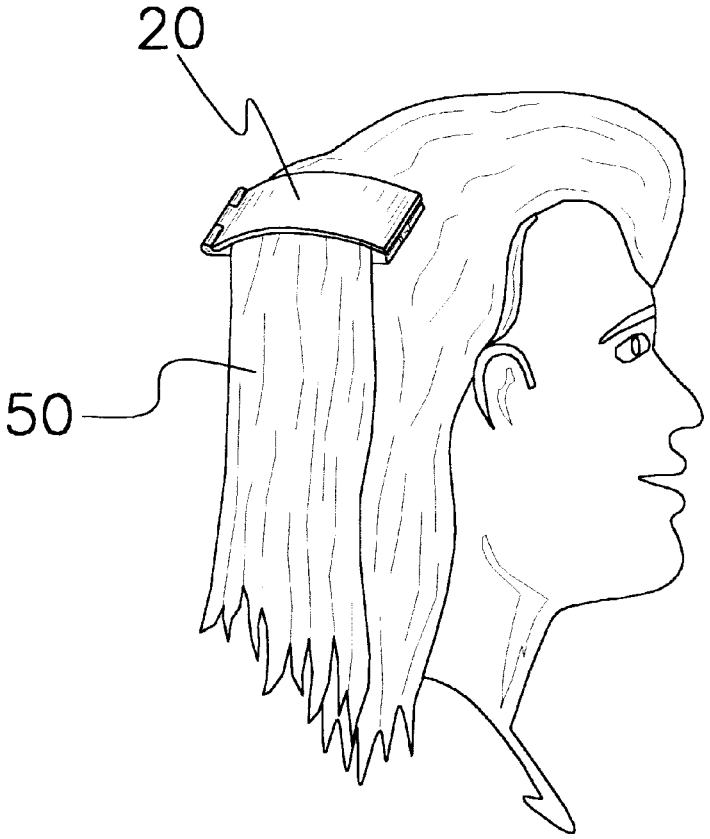
FIG. 4 is a schematic perspective view of the present invention in use.

With reference now to the drawings, and in particular to FIGS. 1 through 4 thereof, a new detachable hairpiece embodying the principles and concepts of the present invention and generally designated by the reference numeral 10 will be described.

As best illustrated in FIGS. 1 through 4, the detachable hairpiece 10 generally comprises a clip 20 for clipping to a wearer's hair. The clip 20 has an outer portion 30 and a brush portion 40 that is pivotally coupled to the outer portion 30. The brush portion 40 has a brush panel 44 that extends between opposed side members 43 of the brush portion 40. The brush panel 44 has a plurality of rows of prongs 45. Each of the rows extends between the first and second end members 41,42 of the brush portion 40. Root portions 51 of a plurality of strands 50 of natural or synthetic hair are coupled to the outer portion 30. Preferably, the outer portion 30 of the clip 20 is arcuate. Also preferably, the strands 50 comprise natural human hair because of its more natural look and feel.

The brush portion 40 has first and second end members 41,42 and a pair of side members 43 that extend between the first and second end members 41,42. This annular design lets the area of the head positioned under the clip 20 breathe for more comfort.

Preferably, the brush panel 44 of the brush portion 40 is curved and deformable. The brush panel 44 curves outwardly towards the outer panel to compress a wearer's hair held in the clip 20 between it and the outer panel. The brush panel 44 is deformable such that it will give more or less, depending on how much hair is in the clip 20, when the clip 20 is closed to keep the clip 20 clamped onto the wearer's hair without crimping the hair.

Preferably, the brush panel 44 has between about 3 and 15 rows of equally spaced prongs 45. Each of the rows extends between the first and second end members 41,42 of the brush portion 40. Each of the rows of prongs 45 has between about 6 and 16 prongs 45. In an exemplary embodiment, the brush panel 44 has about seven rows of generally conical prongs 45. Each of the rows has about 12 prongs 45.

Also preferably, the outer portion 30 has front and back sides 31,32, the back side 32 facing towards the brush portion 40 when the clip 20 is in a closed orientation. The root portions 51 of the strands 50 are coupled to the back side 32 of the outer portion 30.

Preferably, an adhesive 60 couples the strands 50 to the back side 32 of the outer portion 30. More preferably, the adhesive 60 is aligned in between about 1 and 8 spaced apart rows extending between opposite proximal and distal ends 35,36 of the outer member. Ideally, as shown in FIG. 1, the adhesive 60 is aligned in about 5 spaced apart generally parallel rows. Alternative coupling means include double sided tape and stitching.

Preferably, the second end member 42 of the brush portion 40 has a fastener channel 46 extended inwardly thereof. The distal end 36 of the outer portion 30 has a fastener flange 33 extending from it that is received in the channel to lock the clip 20 in a closed orientation. Ideally, the second end member 42 of the brush portion 40 has a raised portion 47 for engaging the distal end 36 of the outer portion 30 so that the outer portion 30 doesn't squeeze so tightly on the brush panel 44.

Also preferably, the proximal end 35 of the outer portion 30 has a loop 34 extending from it. The first end member 41 of the brush portion 40 is pivotally disposed in the loop 34.

Preferably, the length of the brush portion 40 between the first and second end members 41,42 thereof is between about 2 and 6 inches. The length of the outer portion 30 between the proximal and distal ends thereof is between about 2 and 6 inches. In the preferred embodiment, the length of the brush portion 40 between the first and second end members 41,42 thereof is about 3½ inches and the length of the outer portion 30 between the proximal and distal ends thereof is about 4 inches.

Optionally, a second clip (not shown) alike to and used in tandem with another clip 20 already clipped to the user's hair is clipped to lower portions of the strands 50 to give the appearance of even longer hair. The second clip would comprise generally the same components as the clip 20 described above, including a second brush portion and a second outer portion. A plurality of second strands of hair (not shown) would be coupled to the second outer portion. The second clip and second strands could also be coupled to a wearer's hair alongside the clip 20. The strands of the two clips could be braided together or formed into some other type of hairstyle.

In use, the clip 20 is opened and the brush portion 40 is positioned towards the head of a user. A portion of the user's hair is laid over the brush panel 44 and the clip is closed and the fastener flange 33 locked in the fastener channel 46. The wearer's hair is clamped between the brush panel 44 and the outer portion 30 to help keep the wearer's hair from slipping out of the clip 20. The prongs 45 also help keep the hair from slipping out.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A hairpiece, comprising:

a clip for clipping to a wearer's hair, said clip having an outer portion and a brush portion being pivotally coupled to said outer portion;

said brush portion having first and second end members and a pair of side members extending between said first and second end members;

said brush portion having a brush panel extending between said side members of said brush portion;

said brush panel having a plurality of rows of prongs, each of said rows extending between said first and second end members of said brush portion;

a plurality of strands of hair, root portions of said strands being coupled to said outer portion; and a second clip being clipped to lower portions of said strands, said second clip having a second brush portion, a second outer portion, and a plurality of second strands of hair coupled thereto.

2. The hairpiece of claim 1, wherein said brush panel is curved and deformable.

3. The hairpiece of claim 1, wherein said brush panel has between about 3 and 15 rows of equally spaced prongs.

4. The hairpiece of claim 1, wherein said brush panel has about seven rows of prongs.

5. The hairpiece of claim 1, wherein each of said rows of prongs has between about 6 and 16 prongs.

6. The hairpiece of claim 1, wherein each of said rows has about 12 prongs.

7. The hairpiece of claim 1, wherein said outer portion has front and back sides, said back side facing towards said brush portion when said clip is in a closed orientation, root portions of said strands being coupled to said back side of said outer portion.

8. The hairpiece of claim 1, wherein an adhesive couples said strands to said outer portion, said adhesive being aligned in between about 1 and 8 spaced apart rows extending between opposite proximal and distal ends of said outer member.

9. The hairpiece of claim 8, wherein said adhesive is aligned in about 5 spaced apart generally parallel rows.

10. The hairpiece of claim 1, wherein said second end member of said brush portion has a fastener channel being extended inwardly thereof, a distal end of said outer portion having a fastener flange extending therefrom, said fastener flange being received in said channel for locking said clip in a closed orientation, a proximal end of said outer portion having a loop being extended therefrom, said first end member of said brush portion being pivotally disposed in said loop.

11. A hairpiece, comprising:

a clip for clipping to a wearer's hair, said clip having an outer portion and a brush portion being pivotally coupled to said outer portion;

said brush portion having first and second end members and a pair of side members extending between said first and second end members;

said brush portion having a brush panel extending between said side members of said brush portion;

said brush panel having a plurality of rows of prongs, each of said rows extending between said first and second end members of said brush portion;

a plurality of strands of hair, root portions of said strands being coupled to said outer portion; and a second clip being clipped to a wearer's hair and positioned adjacent said clip, said second clip having a second brush portion, a second outer portion, and a plurality of second strands of hair coupled thereto, said strands and said second strands being braided together.

12. The hairpiece of claim 11, wherein said brush panel is curved and deformable.

13. The hairpiece of claim 11, wherein said brush panel has between about 3 and 15 rows of equally spaced prongs.

14. The hairpiece of claim 11, wherein said brush panel has about seven rows of prongs.

15. The hairpiece of claim 11, wherein each of said rows of prongs has between about 6 and 16 prongs.

16. The hairpiece of claim 11, wherein said outer portion has front and back sides, said back side facing towards said brush portion when said clip is in a closed orientation, root portions of said strands being coupled to said back side of said outer portion.

17. The hairpiece of claim 11, wherein an adhesive couples said strands to said outer portion, said adhesive being aligned in between about 1 and 8 spaced apart rows extending between opposite proximal and distal ends of said outer member.

18. The hairpiece of claim 17, wherein said adhesive is aligned in about 5 spaced apart generally parallel rows.

19. The hairpiece of claim 11, wherein said second end member of said brush portion has a fastener channel being extended inwardly thereof, a distal end of said outer portion having a fastener flange extending therefrom, said fastener flange being received in said channel for locking said clip in a closed orientation, a proximal end of said outer portion having a loop being extended therefrom, said first end member of said brush portion being pivotally disposed in said loop.

20. A hairpiece, comprising:

a clip for clipping to a wearer's hair, said clip having an arcuate outer portion and a brush portion being pivotally coupled to said outer portion;

said brush portion having first and second end members and a pair of side members extending between said first and second end members;

said brush portion having a curved deformable brush panel extending between said side members of said brush portion;

said brush panel having between about 3 and 15 rows of equally spaced prongs, wherein said brush panel has about seven rows of prongs, each of said rows extending between said first and second end members of said brush portion;

each of said rows of prongs having between about 6 and 16 prongs, wherein each of said rows has about 12 prongs;

said outer portion having front and back sides, said back side facing towards said brush portion when said clip is in a closed orientation;

a plurality of strands of natural hair, root portions of said strands being coupled to said back side of said outer portion;

wherein an adhesive couples said strands to said back side of said outer portion, said adhesive being aligned in between about 1 and 8 spaced apart rows extending between opposite proximal and distal ends of said outer member, wherein said adhesive is aligned in about 5 spaced apart generally parallel rows;

said second end member of said brush portion having a fastener channel being extended inwardly thereof, a distal end of said outer portion having a fastener flange extending therefrom, said fastener flange being received in said channel for locking said clip in a closed orientation;

said second end member of said brush portion having a raised portion for engaging said distal end of said outer portion;

a proximal end of said outer portion having a loop being extended therefrom, said first end member of said brush portion being pivotally disposed in said loop;

wherein the length of said brush portion between said first and second end members thereof is between about 2 and 6 inches, wherein the length of said brush portion between said first and second end members thereof is about 3½ inches;

wherein the length of said outer portion between said proximal and distal ends thereof is between about 2 and 6 inches, wherein the length of said outer portion between said proximal and distal ends thereof is about 4 inches; and a second clip being clipped to lower portions of said strands, said second clip having a second brush portion and a second outer portion, a plurality of second strands of hair being coupled to said second outer portion.

* * * * *